US006116932A

United States Patent [19]

Kawakita

[11] Patent Number: 6,116,932

[45] Date of Patent: Sep. 12, 2000

[54] CONNECTOR DEVICE

[75] Inventor: Kozo Kawakita, Kanagawa, Japan

[73] Assignee: Sony Corporation, Tokyo, Japan

[21] Appl. No.: 09/135,883

[22] Filed: Aug. 18, 1998

[30] Foreign Application Priority Data

Aug. 20, 1997 [JP] Japan ..... 9-223587

[51] Int. Cl.[7] ..... H01R 27/00

[52] U.S. Cl. ..... 439/224; 439/374; 439/335

[58] Field of Search ..... 439/218, 221, 439/222, 224, 335, 336, 342, 376, 374

[56] References Cited

U.S. PATENT DOCUMENTS

| | | | |
|---|---|---|---|
| 3,986,762 | 10/1976 | Reeder | 439/218 |
| 4,655,522 | 4/1987 | Beck, Jr. et al. | 439/224 |
| 5,087,207 | 2/1992 | Byrne | 439/218 |
| 5,197,889 | 3/1993 | Rizzo et al. | 439/76 |
| 5,222,670 | 6/1993 | Huang | 439/222 |
| 5,716,225 | 2/1998 | Stringer et al. | 439/221 |
| 5,847,345 | 12/1998 | Harrison | 439/224 |

FOREIGN PATENT DOCUMENTS 9207496 10/1992 Germany .

*Primary Examiner*—Renee Luebke
*Assistant Examiner*—T. C. Patel
*Attorney, Agent, or Firm*—Limbach & Limbach L.L.P.

[57] ABSTRACT

A connector device for signal interconnection and mechanical interconnection of a plurality of components, which comprises the first connector, having signal connection terminals, set at the first component, the second connector, having signal connection terminals, set at the second component, and the third connector, having signal connection terminals connecting with the signal connection terminals of the first connector or the signal connection terminals of the second connector, set at the third component. The third connector has connection fixing parts and for connecting and fixing the first connector by moving it along the first direction substantially along a connection surface of the third connector or for connecting and fixing the second connector by moving it along the second direction intersecting the first direction of the third connector.

15 Claims, 11 Drawing Sheets

CONNECTOR DEVICE

BACKGROUND OF THE INVENTION

1. Field of the Invention

The present invention relates to a connector device for signal interconnection and mechanical interconnection of a plurality of components.

2. Description of the Related Art

Methods for connecting a plurality of components to each other or for connecting components and signals (electrical wiring cables) may be roughly divided into two types. With the conventional connector device shown in FIG. 1, a male connector 1001 is inserted into a female connector 1000 in a direction V1 perpendicular to a connector surface 1002 of the female connector 1000 for being connected. This type of connector is used in BNC (bayonet lock type N Connector) connectors, IC (integrated circuit) sockets and cordless telephone chargers etc.

FIG. 2 and FIG. 3 show another example of the conventional connector device, with a male connector 1006 being connected to a female connector 1005 in a horizontal direction H1. This is applied to, for example, camera strobes or secondary battery chargers.

The conventional connector devices of FIG. 1 and FIG. 2 have the following problems. The direction of connecting the male and female connectors is limited to just the vertical direction V1 in FIG. 1 and the horizontal direction H1 in FIG. 2. The signals of the male and female connectors therefore cannot be subjected to signal connection when an obstacle is placed in the direction of connection.

For example, FIG. 4 shows an example of an actual application of the conventional connector device of FIG. 2 and FIG. 3 where a female connector 1005 is fixed to a component 1007. When the male connector 1006 is moved in the horizontal direction H1 with respect to the female connector 1005 for being connected, another component 1008 present in the horizontal direction H1 therefore prevents the male connector 1006 to be connected to the female connector 1005.

Further, there is also the case where the male and female connectors cannot be connected due to the shape of the component. FIG. 5 shows an example of this, where the female connector 1005 is fixed to a component 1010 and a male connector 1011 is fixed to the other component 1012. The following problem then occurs due to the component 1012 having a projection 1013. When the male connector 1011 of the component 1012 is moved in the horizontal direction H1 in order to connect electrically a signal with the female connector 1005 of the component 1010, a side surface of the component 1010 interferes with the projection 1013 and the male connector 1011 cannot connect a signal to the female connector 1005.

When the direction of connection and the direction of force applied to the connector device coincide, it becomes sometimes difficult to maintain the strength of the mechanical connection. When the male connector 1001 is electrically connected to the female connector 1000 along the direction V1 perpendicular to the connection surface 1002 of the female connector 1000 shown in FIG. 1, in many cases they are prevented from coming off by simply providing a hanging claw, but when the direction of external forces such as gravity acting on the connector device coincides with the vertical direction V1, force is concentrated onto the claw and there is the possibility that the claw will be damaged.

SUMMARY OF THE INVENTION

An object of the present invention is to provide a connector device capable of undergoing signal connection and mechanical connection of a plurality of components in a limited space.

In the present invention, the above object is achieved by a connector device for signal interconnection and mechanical interconnection of a plurality of components, comprising the first connector, having signal connection terminals, set at the first component, the second connector, having signal connection terminals, set at the second component and the third connector, having signal connection terminals connecting with the signal connection terminals of the first connector or the signal connection terminals of the second connector, set at the third component. The third connector has connection fixing parts for connecting and fixing the first connector by moving it along the first direction substantially along a connection surface of the third connector or for connecting and fixing the second connector by moving it along the second direction intersecting the first direction of the third connector.

In the present invention, the first connector is set at the first component and the second connector is set at the second component. The third connector is set at the third component and the signal connection terminals of the third connector are connected with one of either the signal connection terminals of the first connector or the signal connection terminals of the second connector.

In this case, the first connection fixing part can connect and fix the first connector by using the connection fixing part with the first connector being moved along the first direction substantially along the connection surface of the third connector. Alternatively, the second connection fixing part can connect and fix the second connector by using the connection fixing part with the second connector being moved along the second direction that intersects the first direction of the third connector.

In this way, one of either the first connector or the second connector can be selected and subjected to signal connection and mechanical connection to the third connector, and the first component and the third component or the second component and the third component can be easily subjected to signal connection and mechanical connection.

The above object can also be achieved by a connector device for signal interconnection and mechanical interconnection of a plurality of components, comprising the third connector for connecting one of the first connector, having signal connection terminals, set at the first component, and the second connector, having signal connection terminals, set at the second component. The third connector comprises the first connection fixing part for connecting and fixing the first connector by moving it in the first direction substantially along a connection surface of the third connector, and the second connection fixing part for connecting and fixing the second connector by moving it along the second direction intersecting the first direction of the third connector.

In the present invention, the third connector connects with one of either the first connector set at the first component and the second connector set at the second component. The third connector has the first connection fixing part and the second connection fixing part. The first connection fixing part can be used for connecting and fixing the first connector by moving it along the first direction substantially along the connection surface of the third connector. Similarly, the second connection fixing part can be used for connecting and fixing the second connector by moving it along the second direction that intersects the first direction of the third connector.

As a result of the above, one of either the first or second connector can be selected and subjected to signal connection and mechanical connection to the third connector. The first component and the third component or the second component and the third component can then easily be subjected to signal connection and mechanical connection.

DETAILED DESCRIPTION OF THE PREFERRED EMBODIMENTS

The following is a detailed description of a preferred embodiment of the present invention based on the appended drawings.

In the embodiment described below, various technologically preferable limitations are imposed to give a specific preferred example of the present invention, but the scope of the present invention is by no means limited to this embodiment in the following explanation unless otherwise described to limit the present invention.

Figure 1:
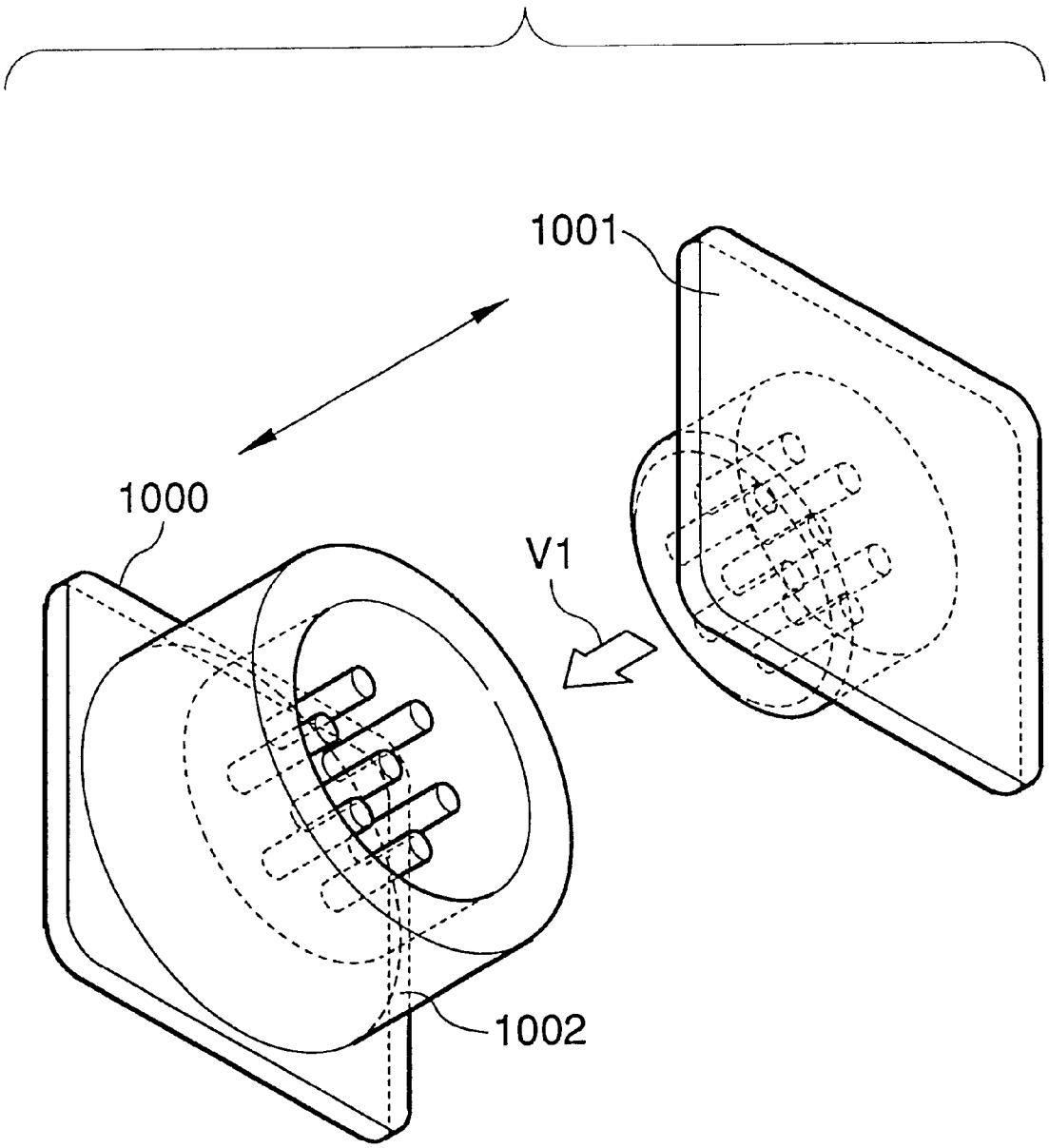
FIG.1 (PRIOR ART)
FIG. 1 is a view showing a conventional connector device.
Figure 2:
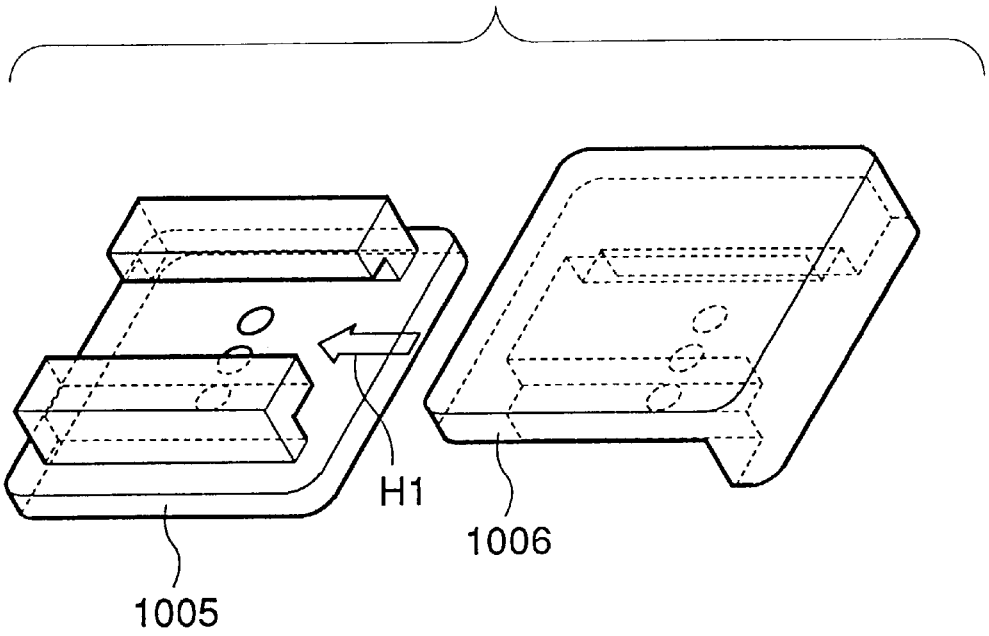
FIG.2 (PRIOR ART)
FIG. 2 is a view showing another example of a conventional connector device.
Figure 3:
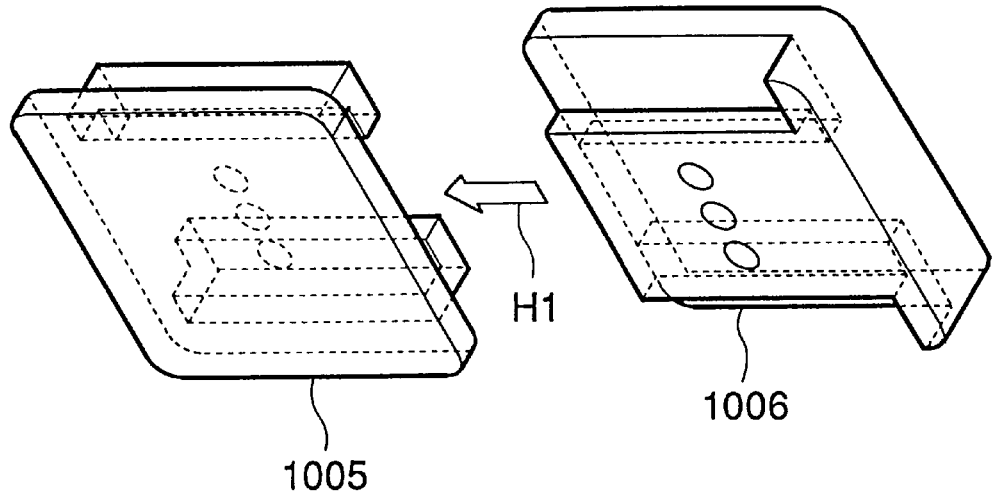
FIG.3 (PRIOR ART)
FIG. 3 is a view showing the connector device of FIG. 2.
Figure 4:
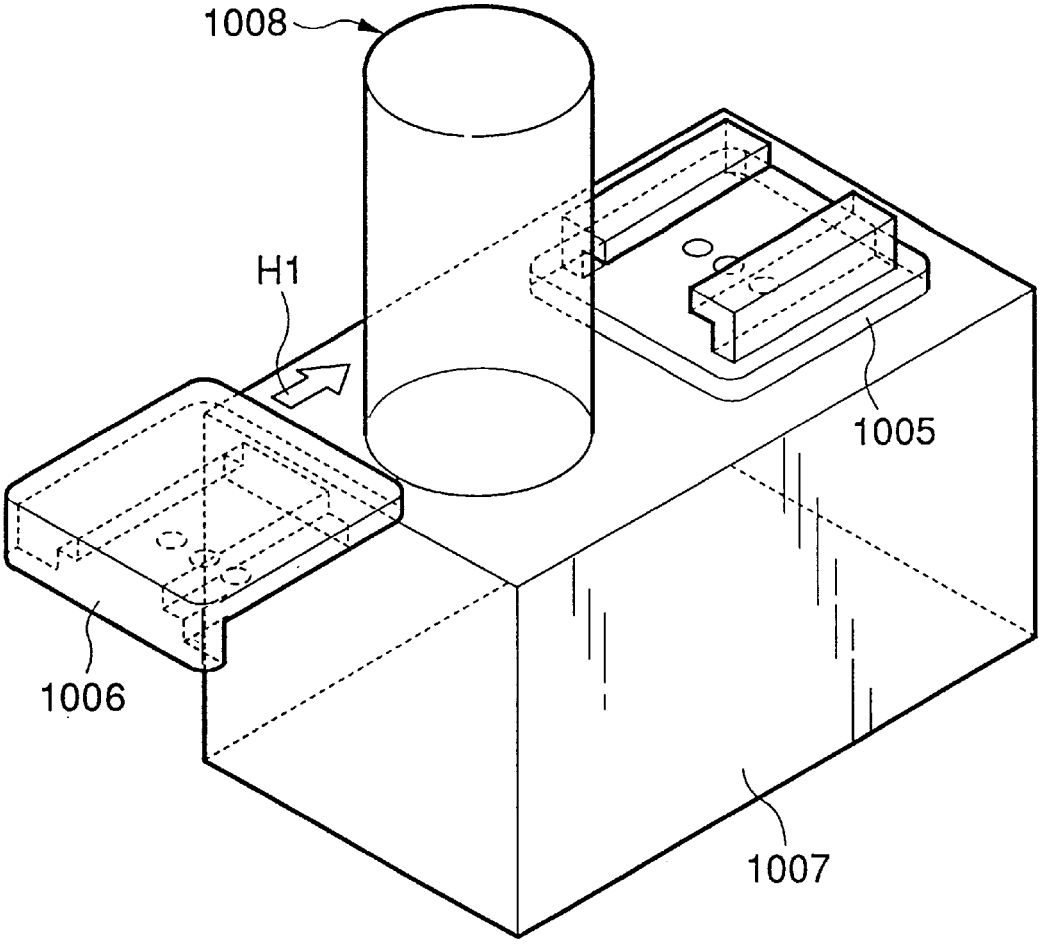
FIG.4 (PRIOR ART)
FIG. 4 is a view showing an example of using the conventional connector device.
Figure 5:
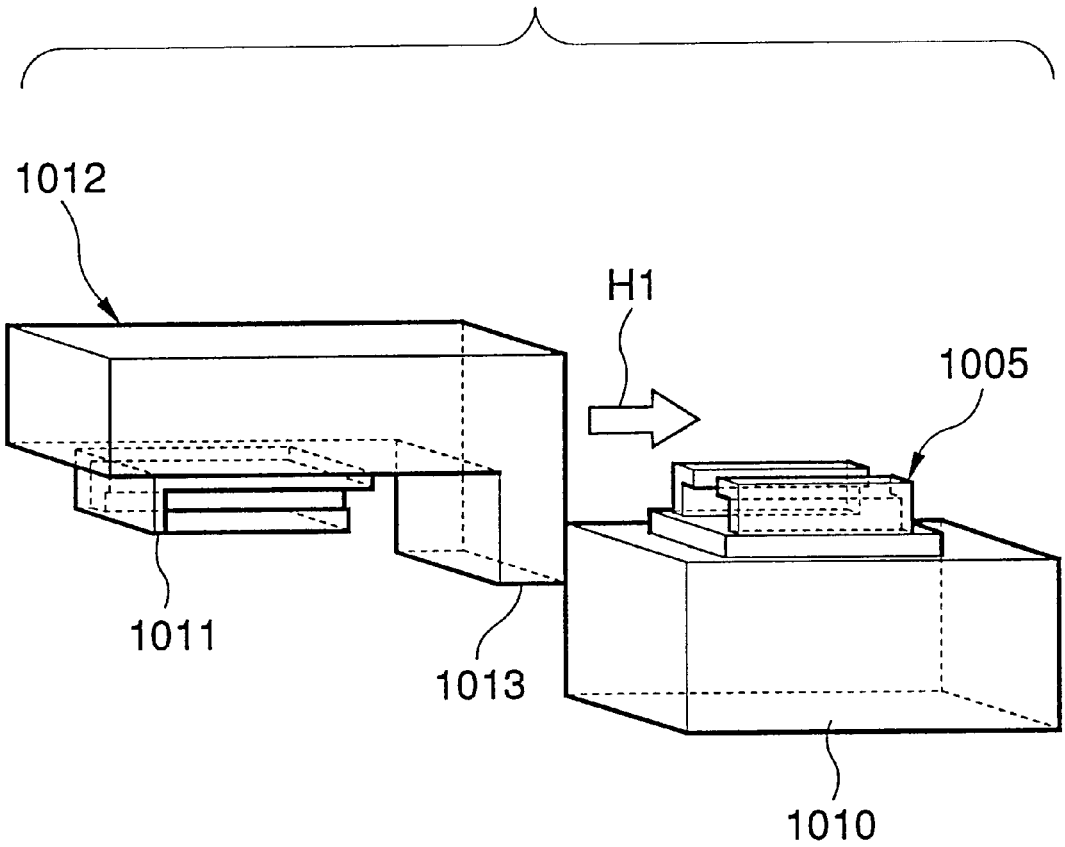
FIG.5 (PRIOR ART)
FIG. 5 is a view showing an example of using the conventional connector device.
Figure 6:
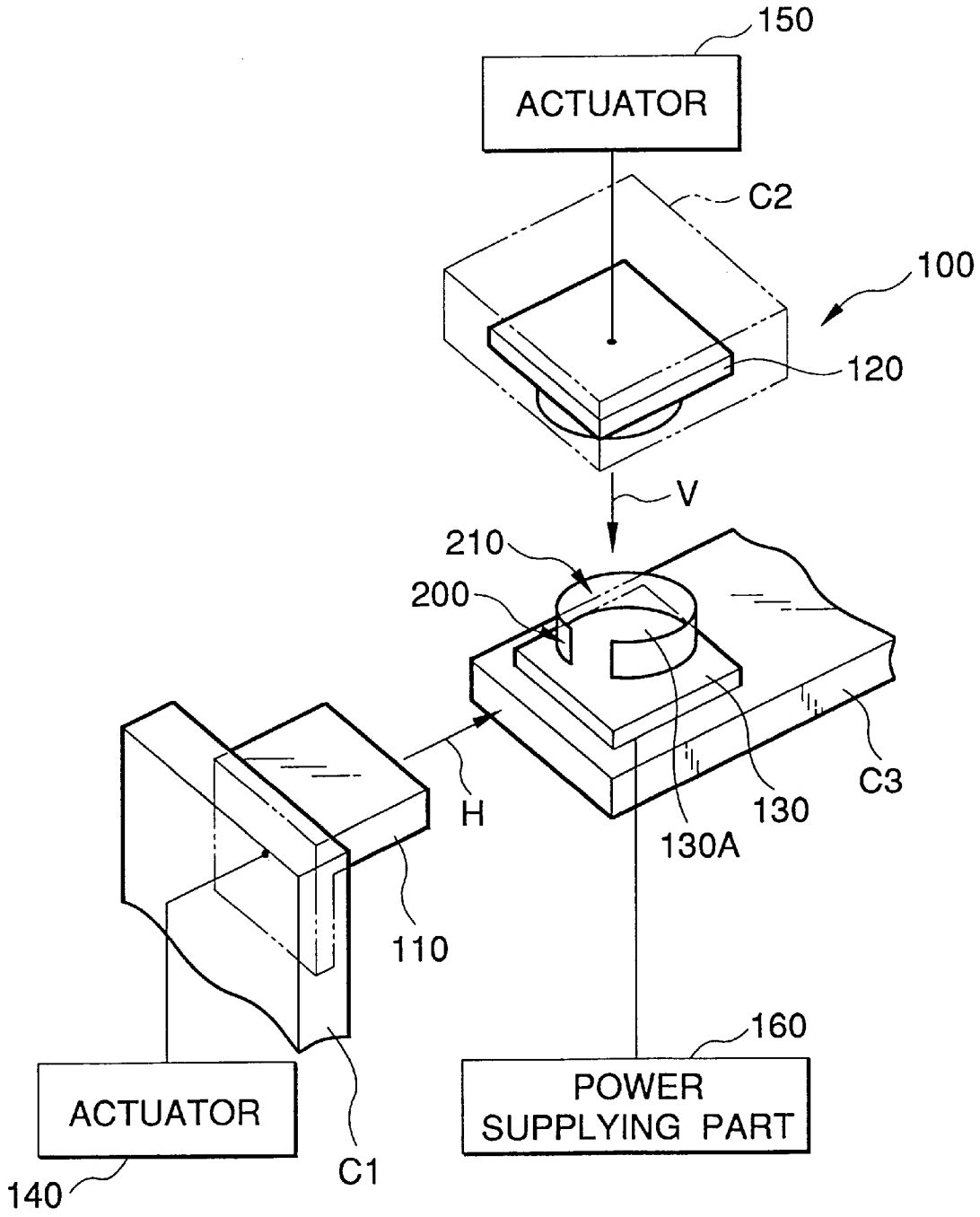
FIG. 6 is a perspective view conceptually showing a preferred embodiment of a connector device of the present invention.

FIG. 6 is a conceptual illustration of a preferred embodiment of a connector device of the present invention. In FIG. 6, a connector device 100 is equipped with at least the third connector 130, with the first connector 110 or the second connector 120 being selectively connected to this third connector 130 electrically and mechanically.

The first connector 110 is also referred to as the first male connector or a plug, and is fixed to the first component C1.

The second connector 120 is also referred to as the second male connector or a plug, and is fixed to the second component C2.

The third connector 130 is also referred to as a female type connector or receptacle, and is connected with the third component C3.

The first component C1, second component C2 and third component C3 can include structural elements of usual mechanical appliances, structural elements of usual electrical or electronic appliances, or mere electric cables.

For example, when the first component C1 is taken to be a leg comprising a robot, the first component C1 is equipped with an actuator 140 such as an electric motor. Similarly, when the second component C2 is also, for example, a robot leg, the second component C2 is also equipped with an actuator 150 such as an electric motor.

When the third component C3 is, for example, a robot body, the third component C3 is equipped with, for example, a power supplying part 160.

The first connector 110 of the first component C1 can be mechanically and electrically connected with the third connector 130 of the third component C3 along the first direction H.

Similarly, the second connector 120 of the second component C2 can be mechanically and electrically connected with the third connector 130 of the third component C3. By selectively connecting one of either the first connector 110 or the second connector 120 with the third connector 130 electrically and mechanically, the actuator 140 of the first component C1 and the power supplying part 160 of the third component C3 can then be electrically interconnected, or the actuator 150 of the second component C2 and the power supplying part 160 of the third component C3 can be electrically connected.

Figure 7:
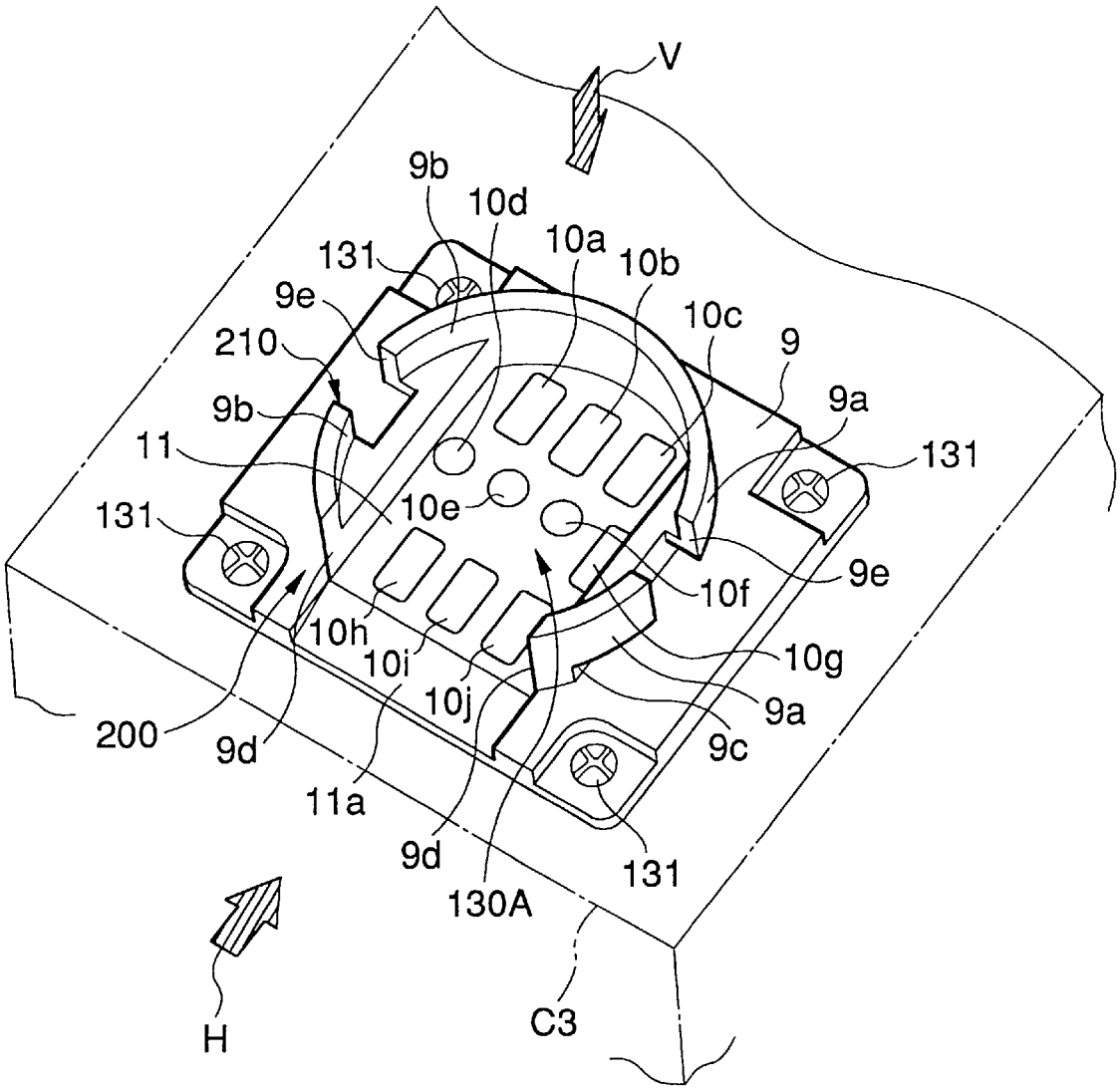
FIG. 7 is a perspective view showing an example of configuration of the third connector of the connector device of FIG. 6.

Next, the structure of the third connector 130 of the third component C3 is described with reference to FIG. 7. The third connector 130 is also referred to as a female connector or a receptacle and is fixing to the third component C3 with screws 131. The third connector 130 has a main body 9, a plurality of electrical contact points 10*a* to 10*j* and an insulator 11.

The main body 9 is made, for example, of metal or plastic and has the first connection fixing part 200 and the second connection fixing part 210. As shown in FIG. 6 and FIG. 7, the first connection fixing part 200 is a portion for securely fixing, both mechanically and electrically, the first connector 110 to the third connector 130. The second connection fixing part 210 is a portion for securely fixing, both mechanically and electrically, the second connector 120 to the third connector 130 as shown in FIG. 6 and FIG. 7.

The first connection fixing part 200 and the second connection fixing part 210 are equipped with cylindrical portions 9*a* and 9*b* of the main body 9.

The first connection fixing part 200 is provided with slots 9*c*, a cut 9*d* and cuts 9*e* at the cylindrical portions 9*a* and 9*b* for connecting the first connector 110 to the third connector 130 both electrically and mechanically in the first direction H. Similarly, the second connection fixing part 210 is also provided with cuts 9*e* and slots 9*c* at the cylindrical portions 9*a* and 9*b*.

In this way, the first connection fixing part 200 and the second connection fixing part 210 are therefore constructed with shared slots and cuts.

Next, a connection surface 130A is provided at the inside of the cylindrical portions 9*a* and 9*b* at the central part of the main body 9. This connection surface 130A is on the side of the surface of the insulator 11 with the electrical contact points 10*a* to 10*j* being arranged at this insulator 11.

Three electrical contact points 10*d*, 10*e* and 10*f* of the electrical contact points 10*a* to 10*j* are circular in shape and these contact points 10*d*, 10*e* and 10*f* are contact points to be used for signal lines. The remaining electrical contact points 10*a*, 10*b*, 10*c*, 10*g*, 10*h*, 10*i* and 10*j* are contact points for power supply use. The electrical contact points 10*a* and 10*h*, 10*b* and 10*i*, and 10*c* and 10*j* are for common lines in order to guarantee current capacity and the electrical contact point 10*f* is a stand-alone contact point.

The positions of the electrical contact points are shifted and the three groups of electrical contact points 10*a* and 10, 10*b* and 10*i*, and 10*c* and 10*j* for these common lines are arranged on straight lines in parallel with the first direction H such that the contact points of the first connector 110 do not come into contact with contact points other than the corresponding electrical contact points 10*a* to 10*j* of the third connector 130 while the first connector 110 is connected electrically and mechanically to the third connector 130 from the first direction H.

The lengths of terminals for the electrical contact points 10*d*, 10*e* and 10*f* for signal line use and the lengths of terminals for the electrical contact points 10*a*, 10*b*, 10*c*, 10*g*, 10*h*, 10*i* and 10*j* for power supply line use are made different. During electrical connection, the order in which contact is made with the electrical contact points is provided so that the contact of electrical contact points 10*a*, 10*b*, 10*c*, 10*g*, 10*h*, 10*i* and 10*j* for power supply line use comes first, followed by that of the electrical contact points 10*d*, 10*e* and 10*f* for signal line use.

A tapered part 11*a* is formed at the insulator 11. The tapered part 11*a* is provided so that the electrical contact points of the first connector 110 are moved in the first direction H to ensure electrical connections with the electrical contact points 10*a* to 10*j* of the third connector 130, respectively.

Next, the structure of the first connector 110 and the way of connecting the first connector 110 and the third connector 130 are described with reference to FIG. 8 and FIG. 9.

Figure 8:
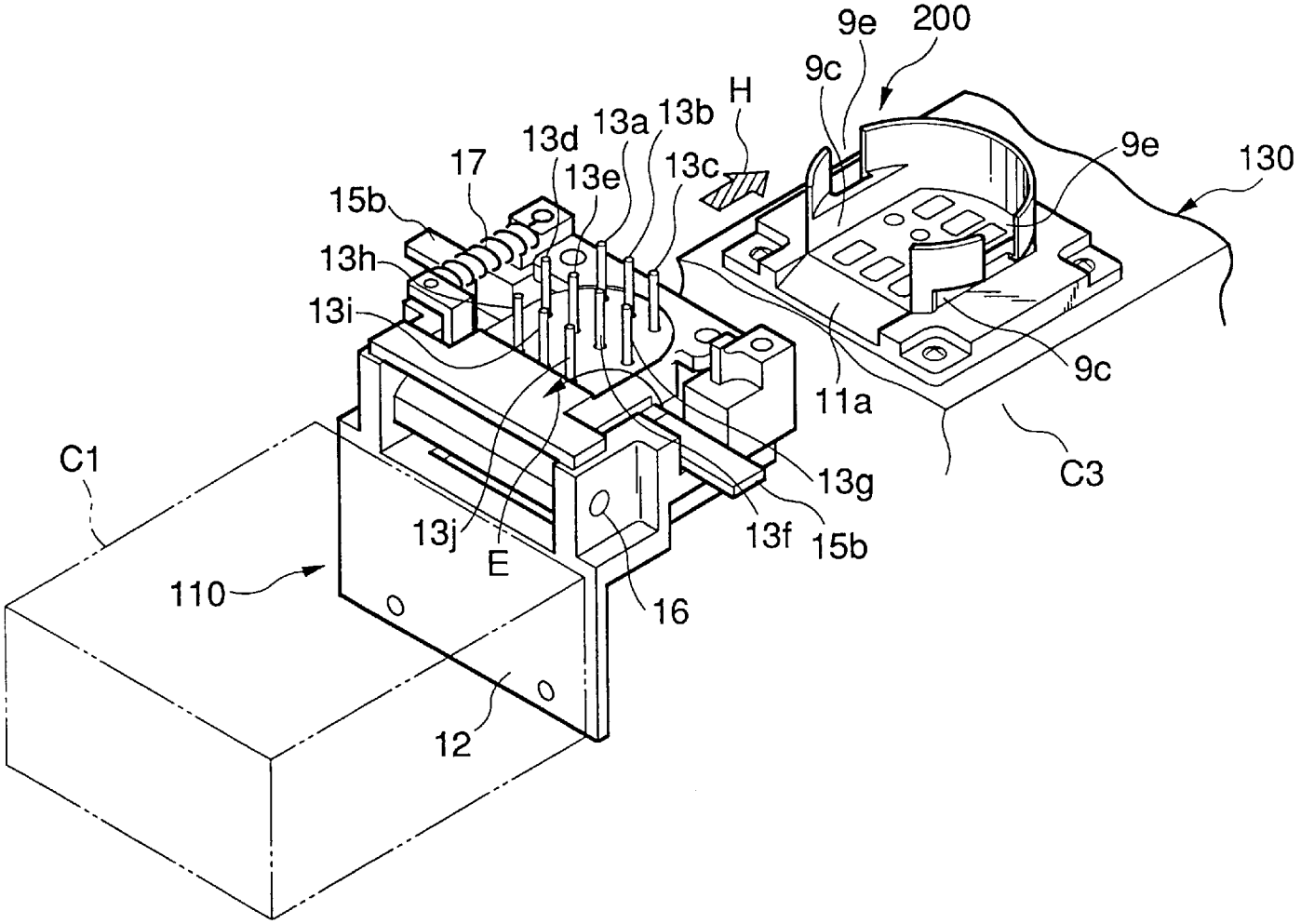
FIG. 8 is a perspective view showing the configuration of the first connector and the third connector.
Figure 9:
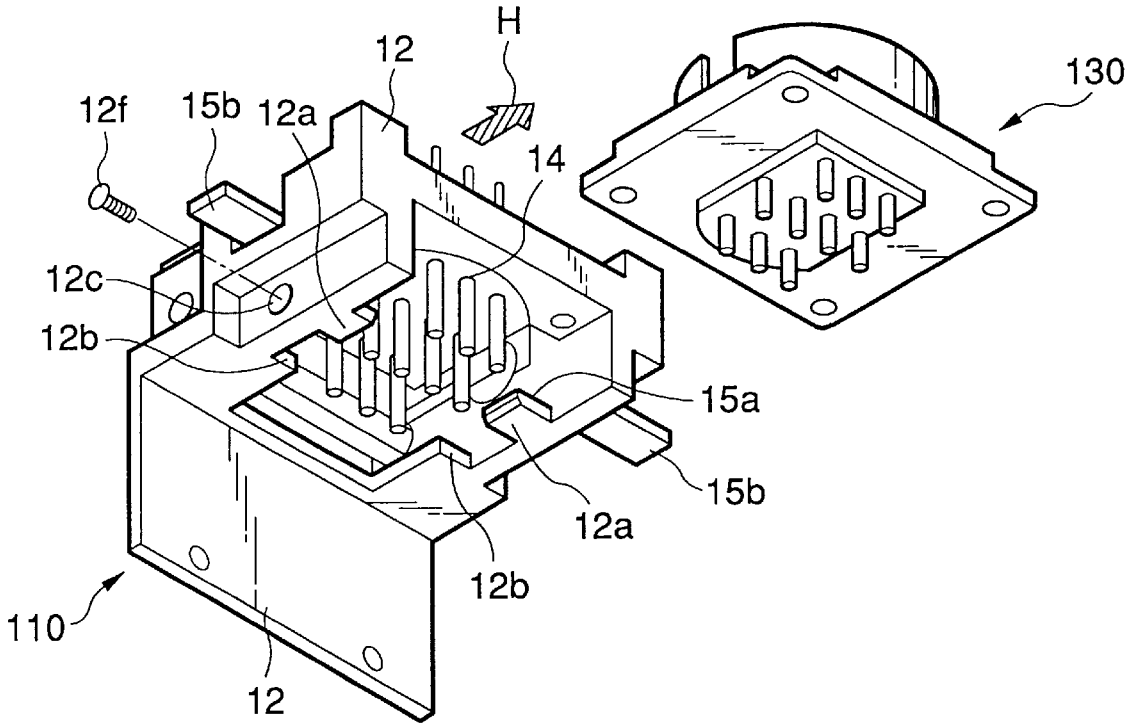
FIG. 9 is a perspective view showing the configuration of the first connector and the third connector viewed from the bottom side.

As shown in FIG. 8 and FIG. 9, the first connector 110 is made of plastic or metal and has projections 12*a* and 12*b* at its lower side. These projections 12*a* and 12*b* are formed to project so that they face the lower side of the main body 12. The first connector 110 can be mechanically connected to the third connector 130 by the movement of these projections 12*a* and 12*b* along the first direction H to the slot 9*c* of the third connector 130.

The main body 12 has an insulator 14, with spring pins 13*a* to 13*j* projecting from this insulator 14 so as to be lined up in parallel. The longitudinal direction of these spring pins 13*a* to 13*j* is perpendicular to the first direction H. These spring pins 13*a* to 13*j* are set at positions corresponding to the electrical contact points 10*a* to 10*j* of the third connector 130 shown in FIG. 7.

Latches 15*b* are positioned at the upper side of the main body 12 and rotate in the direction E about a shaft 16. A spring 17 is provided at the top part of the main body 12 with this spring 17 pressing the latches 15*b* in the direction opposite to the direction E.

Next, the method for electrically and mechanically connecting the first connector 110 to the third connector 130 is described with reference to FIG. 8 and FIG. 9.

As shown in FIG. 8, the first connector 110 moves toward the tapered part 11*a* on the side of the first connection fixing part 200 of the third connector 130 along the first direction H. As a result, the projections 12*a* and 12*b* of the first connector 110 are fitted into and guided by the slots 9*c* of the third connector 130 to make connection.

At this time, the spring pins 13*a* to 13*j* of the insulator 14 of the first connector 110 proceed along the tapered part 11*a* of the third connector 130 with the latches 15*b* rotating in the direction E about the shaft 16. The latches 15*b*, 15*b* are then snapped into cuts 9*e*, 9*e* of the third connector 130 by the spring 17 and the first connector 110 can be mechanically locked to the third connector 130.

In this state, the spring pins (electrical connecting terminals) 13*a* to 13*j* of the first connector 110 are electrically connected to the corresponding electrical contact points (electrical connecting terminals) 10*a* to 10*j* of the third connector 130.

The third connector 130 and the first connector 110 are thus electrically and mechanically connected securely.

In order to strengthen the connection, if a screw 12*f* is used for a screw hole 12*c* of the first connector 110 for fastening it, the first connector 110 and the third connector 130 can be more firmly connected.

When the connection of the first connector 110 and the third connector 130 is released, the user lifts the latches 15*b*, 15*b* in the direction E to remove the latches 15*a* from the notches 9*e*. The projections 12*a* and 12*b* can then be taken out of the slots 9*c* by pulling the first connector 110 in the direction opposite to the first direction H.

Figure 10:
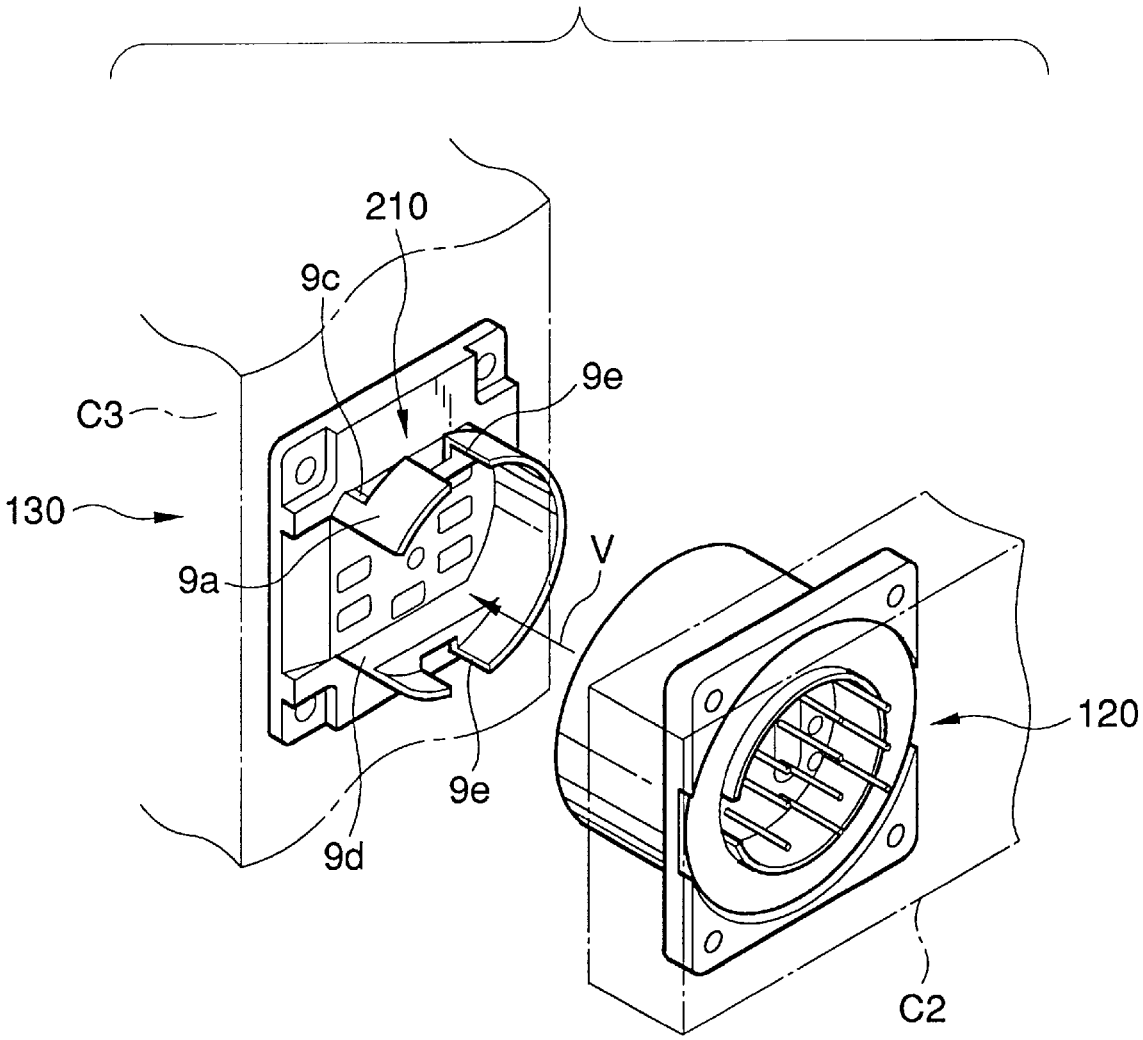
FIG. 10 is a perspective view showing the configuration of the third connector and the second connector.
Figure 11:
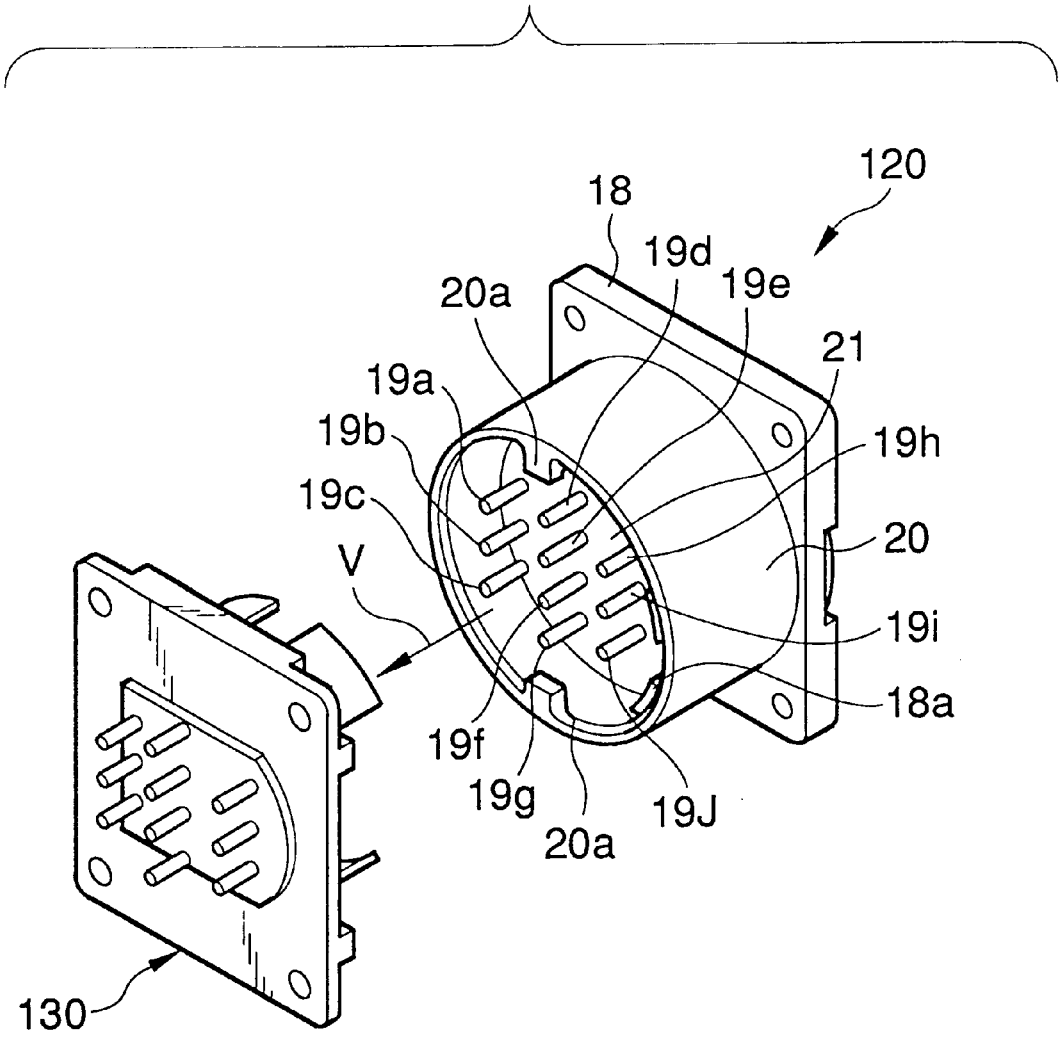
FIG. 11 is a perspective view of the third connector and the second connector viewed from a different direction.

Next, a description is given of the structure of the second connector 120 with reference to FIG. 10 and FIG. 11.

The second connector 120 can be electrically and mechanically connected to the third connector 130 as a result of being moved along the second direction V (perpendicular direction). The second direction V is perpendicular to the first direction (horizontal direction) H and is perpendicular to the third connection surface 130.

A projection 18*a* is provided at the main body 18 of the second connector 120. This projection 18a engages with a cut 9*d* of the third connector 130. The main body 18 is equipped with a locking body 20. This locking body 20 can move freely by a prescribed angle with respect to the main body 18. The main body 18 has an insulator 21. This circular insulator 21 keeps spring pins (electrical contact terminals) 19*a* to 19*j* lined up in parallel.

The insulator 21 and the spring pins 19*a* to 19*j* are positioned within the cylindrical-shaped locking body 20. The locking body 20 is provided with projections 20*a* at its inner side.

Next, a method of electrically and mechanically fixing the second connector 120 to the third connector 130 securely by moving the second connector 120 along the second direction V with respect to the third connector 130 is described.

When the second connector 120 approaches the third connector 130 along the first direction V, the projections 18*a* of the second connector 120 of FIG. 11 are fitted into the cut 9*d* of the third connector 130 of FIG. 10, and the projections 20*a* of the locking body 20 of the second connector 120 of FIG. 11 are inserted to the cuts 9*e* of the third connector 130 of FIG. 10. By rotating the locking body 20, the locking body 20 of the second connector 120 can be fixed to the second connection fixing part 210 of the third connector 130 due to each of the projections 20*a* being engaged with each of the slots 9*c*.

The spring pins 19*d*, 19*e*, and 19*f* of the spring pins 19*a* to 19*j* have an amount of protrusion slightly less than that of the remaining spring pins 19*a*, 19*b*, 19*c*, l9*g*, 19*h*, 19*i* and 19*j*. The seven spring pins 19*a*, 19*b*, 19*c*, 19*g*, 19*h*, 19*i* and 19*j* therefore make electrical contact with the corresponding electrical contact points 10*a*, 10*b*, 10*c*, 10*g*, 10*h*, 10*i* and 10*j* of the third connector 130 shown in FIG. 7 before the three spring pins 19*d*, 19*e*, and 19*f* make electrical contact with the electrical contact points 10*d*, 10*e* and 10*f* of the third connector 130 shown in FIG. 7.

After the second connector 120 is locked to the third connector 130, for example, a claw etc. not shown in the drawings is made to project out at a certain position when the locking body 20 is rotated in order that this locking does not unfastened.

As described above, the first connector 110 or the second connector 120 can be selectively connected electrically and mechanically to the third connector 130 shown in FIG. 6 securely.

Figure 12:
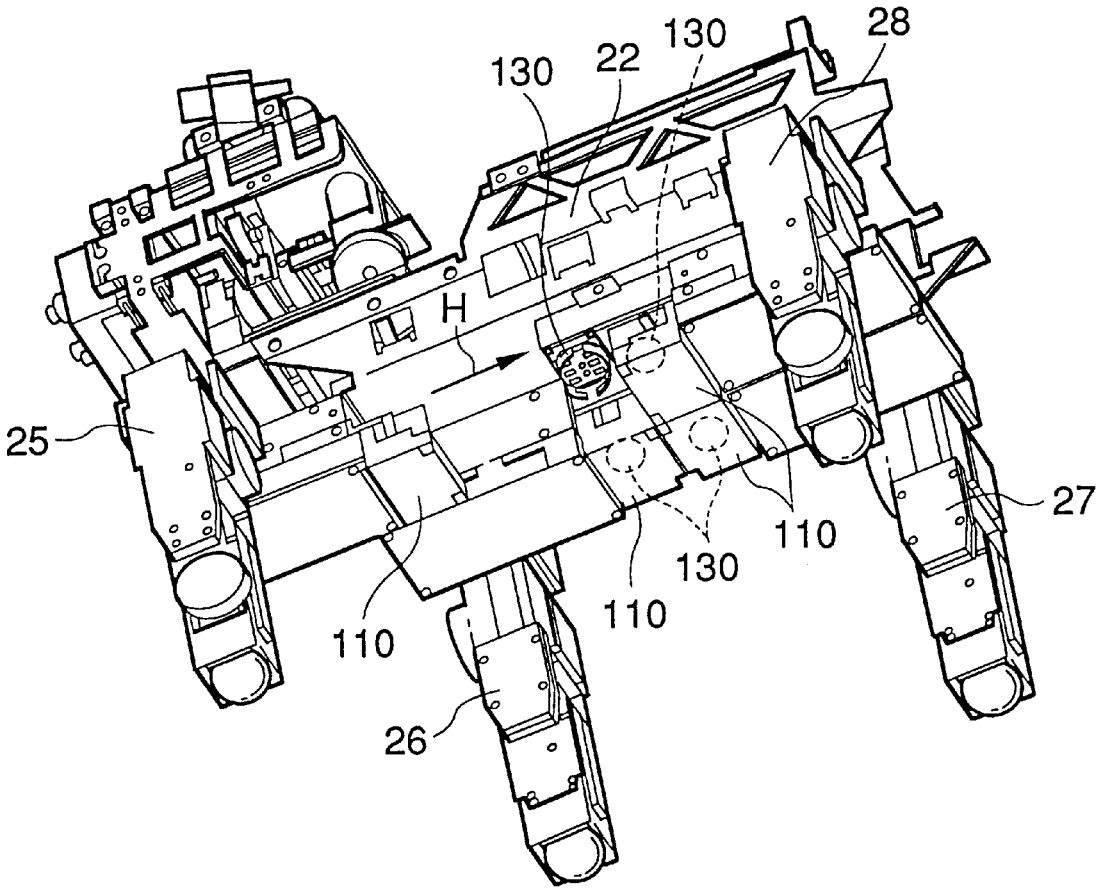
FIG. 12 is a perspective view showing an example of a robot to which the preferred embodiment of the connector device of the present invention is applied.

FIG. 12 shows an example applied to electrically and mechanically connecting the first connector 110 of FIG. 6 to the third connector 130.

The applied example shown in FIG. 12 shows an example of a multi-legged walking robot, particularly a four-legged walking robot. A robot body 22 is equipped with four third connectors (female connectors) 130 for electrically and mechanically connecting four legs 25, 26, 27 and 28. Each of the legs 25, 26, 27 and 28 has a motor built-in as an actuator for moving the leg.

The first connector 110 is provided at each of the legs 25, 26, 27 and 28. The first connectors 110 can then be electrically and mechanically connected to corresponding third connectors 130 by moving the first connectors 110 for the legs 25, 26, 27 and 28 in the first direction H (horizontal direction) along the lower surface of the robot body 22 with respect to the corresponding third connectors 130 on the side of the robot body 22.

Incidentally, the present invention is, however, in no way limited by the above embodiment and various modifications can be considered within the scope of the claims.

In the above embodiment, an example is given of electrically and mechanically connecting a plurality of legs to a robot body but in addition to this, the present invention can also be applied to the cases of electrically and mechanically connecting components of various shapes such as wheels, crawlers, or arms etc. to a robot body.

Without being limited to robots, the connector device according to the present invention can also be applied to achieving electrical as well as mechanical connections of a plurality of components of other kinds or in other regions.

In the above embodiment of the present invention shown in the drawings, the first direction H is horizontal or substantially horizontal to the connection surface 130A of the third connector 130 and the second direction V is perpendicular or substantially perpendicular to the connection surface 130A. The first direction H does not, however, have to be perpendicular to the second direction V and the first and second directions can of course be set at angles other than 90°.

In whichever case, when a plurality of components are electrically and mechanically connected in a complex manner, the direction for connecting the first connector or the second connector for use to the third connector can be chosen. Configurations of a high degree of flexibility with a plurality of component structures such as in the case of a robot device can therefore be variously chosen within a limited space. Further, with this kind of connector device, if the direction of an applied external force, and the direction of connection, for example, the first direction H and the second direction V are made not to coincide, the strength of the connections can be easily increased.

According to the present invention described above, a plurality of components can easily be electrically and mechanically connected within a limited space.

What is claimed is:

1. A connector device for signal interconnection and mechanical interconnection of a plurality of components, comprising:

a first connector, having a first connection surface with a plurality of signal connection terminals extending therefrom, set at a first component;

a second connector, having a second connection surface with a plurality of signal connection terminals extending therefrom, set at a second component; and a third connector, having a third connection surface with a plurality of signal connection terminals for connecting with the signal connection terminals of the first connector or the signal connection terminals of the second connector, set at a third component, the third connector having connection fixing parts for connecting and fixing to the first connector by sliding the first connection surface in a first direction substantially along the third connection surface of the third connector and for connecting and fixing to the second connector by moving the second connection surface toward the third connection surface along a second direction that intersects the first direction of the first connector.

2. The connector device of claim 1, wherein the second direction is substantially perpendicular to the third connection surface of the third connector.

3. The connector device of claim 1, wherein the signal connection terminals of the third connector are flat electrical contacts substantially even with the third connection surface for making contact electrically with the electrical connecting terminals of the first connector or the electrical connecting terminals of the second connector.

4. The connector device of claim 1, wherein the second connector comprising a locking part for locking the second connector by rotating it with respect to the third connector or a locking part for locking the second connector using a claw.

5. The connector device of claim 1, wherein the connection fixing parts comprise:

a main body extending from the third connection surface, the main body have having a cylindrically shaped portion; and a locking body extending from the second connection surface that engages with the main body to fix the third connector to the second connector.

6. The connector device of claim 5, wherein the locking body is cylindrically shaped to engage with the cylindrically shaped portion of the main body.

7. The connector device of claim 1, wherein an amount of protrusion of one of the plurality of connection terminals extending from the first connection surface is different from an amount of protrusion of another one of the plurality of connection terminals extending from the first connection surface.

8. The connector device of claim 1, wherein an amount of protrusion of one of the plurality of connection terminals extending from the second connection surface is different from an amount of protrusion of another one of the plurality of connection terminals extending from the second connection surface.

9. A connector device for signal interconnection and mechanical interconnection of a plurality of components, comprising:

a third connector for connecting to one of a first connector, having a first connection surface with a plurality of signal connection terminals extending therefrom, set at a first component, and a second connector, having a second connection surface with a plurality of signal connection terminals extending therefrom, set at a second component, the third connector comprising:

a third connection surface with a plurality of signal connection terminals;

a first connection fixing part for connecting and fixing to the first connector by sliding the first connection surface in a first direction substantially along the third connection surface of the third connector; and a second connection fixing part for connecting and fixing to the second connector by moving the second connection surface along a second direction intersecting the first direction of the first connector.

10. The connector device of claim 9, wherein the second direction is substantially perpendicular to the third connection surface of the third connector.

11. The connector device of claim 9, wherein the signal connection terminals of the third connector are flat electrical contacts substantially even with the third connection surface for coming electrically into contact with the signal connection terminals of the first connector or the signal connection terminals of the second connector.

12. The connector device of claim 9, wherein the connection fixing parts comprise:

a main body extending from the third connection surface, the main body have having a cylindrically shaped portion; and a locking body extending from the second connection surface that engages with the main body to fix the third connector to the second connector.

13. The connector device of claim 12, wherein the locking body is cylindrically shaped to engage with the cylindrically shaped portion of the main body.

14. The connector device of claim 9, wherein an amount of protrusion of one of the plurality of connection terminals extending from the first connection surface is different from an amount of protrusion of another one of the plurality of connection terminals extending from the first connection surface.

15. The connector device of claim 9, wherein an amount of protrusion of one of the plurality of connection terminals extending from the second connection surface is different from an amount of protrusion of another one of the plurality of connection terminals extending from the second connection surface.

* * * * *